United States Patent [19]

Toya et al.

[11] Patent Number: 4,542,092

[45] Date of Patent: Sep. 17, 1985

[54] COLOR DIFFUSION TRANSFER ELEMENT WITH SPACER LAYER CONTAINING PIGMENT AND SCAVENGER FOR OXIDIZED DEVELOPING AGENT

[75] Inventors: Ichizo Toya; Osamu Takahashi, both of Kanagawa, Japan

[73] Assignee: Fuji Photo Film Co., Ltd., Kanagawa, Japan

[21] Appl. No.: 662,917

[22] Filed: Oct. 19, 1984

[30] Foreign Application Priority Data

Oct. 26, 1983 [JP] Japan ..... 58-200589

[51] Int. Cl.[4] ..... G03C 5/54; G03C 1/40; G03C 1/84

[52] U.S. Cl. ..... 430/510; 430/214; 430/220; 430/505

[58] Field of Search ..... 430/214, 215, 220, 505, 430/510

[56] References Cited

U.S. PATENT DOCUMENTS 4,192,678 3/1980 Chasman et al. ..... 430/214
4,267,250 5/1981 Sakanoue et al. ..... 430/214
4,366,226 12/1982 Hamaoka et al. ..... 430/214

FOREIGN PATENT DOCUMENTS 0668592 8/1963 Canada ..... 430/220
0066341 12/1982 European Pat. Off. ..... 430/220

*Primary Examiner*—Richard L. Schilling
*Attorney, Agent, or Firm*—Sughrue, Mion, Zinn, Macpeak & Seas

[57] ABSTRACT

A photographic element for a diffusion transfer process is described, comprising at least one support having thereon (1) a layer containing a dye-providing compound capable of releasing or forming a diffusible dye or a precursor thereof as a result of development, (2) a silver halide photographic emulsion layer which is in a complementary color relationship with the dye-providing compound, and (3) a substantially non-sensitive spacing layer between the layers (1) and (2) containing a solid pigment, a hydrophilic colloid, and a nondiffusible compound capable of undergoing a redox reaction with the oxidation product of a silver halide developing agent under an alkaline condition.

17 Claims, No Drawings

COLOR DIFFUSION TRANSFER ELEMENT WITH SPACER LAYER CONTAINING PIGMENT AND SCAVENGER FOR OXIDIZED DEVELOPING AGENT

FIELD OF THE INVENTION

This invention relates generally to color diffusion transfer processes, and in particular to photographic elements useful for color diffusion transfer process.

BACKGROUND OF THE INVENTION

In the case of forming a natural color transfer image using dye-providing compounds capable of releasing or forming diffusible dyes as a result of the development of silver halide, a photographic element having three combinations different in color sensitivity composed of dye-providing compounds and photosensitive silver halide emulsion layers which are in complementary color relationships with the compounds is usually used, as described, e.g., in Japanese Patent Application (OPI) No. 33826/73 (the term "OPI" as used herein refers to a "published unexamined Japanese patent application").

However, the aforesaid photographic element frequently encounters a problem in that diffusible dyes released or formed from the dye-providing compounds under an alkaline condition tends to diffuse into the adjacent silver halide emulsion layers to restrain the development of silver halide which should be developed. In particular, the restraining phenomenon is severe when the silver halide emulsion is a direct positive silver halide emulsion and is fog-developed in the presence of a fogging agent (nucleating agent).

The development restraining problem could be solved by forming an isolating layer containing a solid pigment and a hydrophilic colloid between a silver halide photographic emulsion layer and a layer containing a dye-providing compound which is in a complementary color relationship with the photographic emulsion layer, as described in Japanese Patent Application (OPI) No. 17435/83.

However, the formation of the isolating layer composed of a solid pigment and a hydrophilic colloid causes a new problem, in that the sensitivity varies greatly depending upon the temperature of the processing with an alkaline processing liquid, and a need exists to solve this problem.

SUMMARY OF THE INVENTION

Thus, an object of this invention is to provide a photographic element for a color diffusion transfer process having substantially no difference in sensitivity due to differences in the temperature of the processing with an alkaline processing liquid.

As a result of extensive investigations, it has now been discovered that the aforesaid object of this invention can be effectively achieved by a photographic element for color diffusion transfer process comprising a support having thereon (1) a layer containing a dye-providing compound capable of releasing or forming a diffusible dye or a precursor thereof as a result of development, (2) a silver halide photographic emulsion layer which is in a complementary color relationship with the foregoing layer, and (3) a substantially light-insensitive spacing layer between said layers (1) and (2) containing a solid pigment, a hydrophilic colloid, and a nondiffusible compound capable of undergoing a redox reaction with the oxidation product of a silver halide developing agent under an alkaline condition.

DETAILED DESCRIPTION OF THE INVENTION

The terminology "a layer containing a dye-providing compound capable of releasing or forming a diffusible dye or a precursor thereof" and "a silver halide photographic emulsion layer which is in a complementary color relationship with the foregoing layer" means that when the silver halide photographic emulsion layer is, for example, a red-sensitive silver halide emulsion layer, the silver halide emulsion layer is associated particularly with a cyan dye-providing compound (wherein "the cyan dye-providing compound" may be a compound capable of ultimately forming a cyan dye image in an image-receiving layer and it is unnecessary that the color at the case of being released or formed from the cyan dye-providing compound is strictly cyan).

Thus, by disposing the above-described spacing layer between a yellow dye-providing compound-containing layer and a blue-sensitive silver halide emulsion layer, between a magenta dye-providing compound-containing layer and a green-sensitive silver halide emulsion layer, and between a cyan dye-providing compound-containing layer and a red-sensitive silver halide emulsion layer of a color photographic element according to this invention, the sensitivity of a natural color photographic element is substantially constant even when the temperature of the processing of the photographic element with an alkaline processing liquid is varied (i.e., room temperature and outdoors temperature in summer and winter).

Thus, in a preferred embodiment of this invention, the photographic element for color diffusion transfer process of this invention comprises the following layer construction from the uppermost layer to the lowermost layer and the support:

Protective layer
Blue-sensitive silver halide emulsion layer
Spacing layer
Layer containing yellow dye-releasing redox compound capable of releasing diffusible yellow dye
Layer preventing the transfer of dye-releasing redox compound
Layer (interlayer) containing nondiffusible color-mixing preventing agent
Green-sensitive silver halide emulsion layer
Spacing layer
Layer containing magenta dye-releasing redox compound capable of releasing diffusible magenta dye
Layer preventing the transfer of dye-releasing redox compound
Layer (interlayer) containing nondiffusible color-mixing preventing agent
Red-sensitive silver halide emulsion layer
Spacing layer
Layer containing cyan dye-releasing redox compound capable of releasing diffusible cyan dye
Light-shielding layer containing black pigment (a peel-off layer may be exist between two light-shielding layers)
Reflection layer containing white pigment
Mordanting layer containing dye mordant
Transparent support The above-described layer for preventing the transfer of a dye-releasing redox compound is a layer mainly composed of a hydrophilic colloid.

As a hydrophilic colloid which can be used for the spacing layer of this invention, gelatin is particularly useful. Examples of gelatin are limed gelatin, acid-treated gelatin, enzyme-treated gelatin as described in *Bull. Soc. Sci. Phot. Japan,* No. 16, page 30 (1966). Also, hydrolyzed products of gelatin and enzyme-decomposition products of gelatin can be used in this invention. Furthermore, gelatin derivatives such as those obtained by the reaction of gelatin and various compounds such as, for example, an acid halide, an acid anhydride, isocyanates, bromoacetic acid, alkane sultones, vinylsulfonamides, maleinimide compounds, polyalkylene oxides, epoxy compounds, etc. Practical examples of these gelatin derivatives are described in U.S. Pat. Nos. 2,614,928, 3,132,945, 3,186,846, and 3,312,553, British Pat. Nos. 861,414, 1,033,189 and 1,005,784, Japanese Patent Publication No. 26845/67, etc.

Hydrophilic colloids other than gelatin and aforesaid gelatin derivatives that can be used in this invention include proteins such as graft polymers of gelatin and other polymers, albumin, casein, etc.; cellulose derivatives such as hydroxyethyl cellulose, carboxymethyl cellulose, cellulose sulfate esters, etc.; sugar derivatives such as sodium alginate, starch derivatives, etc.; and synthetic hydrophilic polymers such as polyvinyl alcohol, polyvinyl alcohol partial acetal, poly-N-vinylpyrrolidine, polyacrylic acid, polymethacrylic acid, polyacrylamide, polyvinyl imidazole, polyvinyl pyrazole, etc., and copolymers thereof.

Examples of the aforesaid graft polymers of gelatin include products obtained by grafting a homopolymer or copolymer of a vinylic monomer such as acrylic acid, methacrylic acid, the ester or amide derivatives thereof, acrylonitrile, styrene, etc., to gelatin. In particular, a graft polymer of gelatin and a polymer having a compatibility with gelatin to some extent, such as acrylic acid, methacrylic acid, acrylamide, methacrylamide, hydroxyalkyl methacrylate, etc., is preferred. Practical examples thereof are described in U.S. Pat. Nos. 2,763,625, 2,831,767, 2,956,884, etc.

Also, typical examples of synthetic hydrophilic polymers which can be used in this invention as a binder are described, for example, in West German Patent Application (OLS) No. 2,312,708, U.S. Pat. Nos. 3,620,751 and 3,879,205, Japanese Patent Publication No. 7561/68, etc.

The spacing layer in this publication may contain a surface active agent (as a coating aid), a hardening agent, a thickener, a matting agent, etc.

The amount of the hydrophilic colloid used in the spacing layer varies depending on the desired effect and the materials used, but is generally preferred 3 g/m$^2$ or less.

The thickness of the hydrophilic colloid for the spacing layer depends upon the desired effect and the nature of the materials to be used, but is usually about 5 microns or less, and preferably from about 0.05 micron to about 3 microns (dry state).

Examples of the solid pigments which are used for the spacing layers in this invention are white pigments such as titanium oxide, zinc oxide, zirconium oxide, white lead, zinc sulfide, etc.; pigments of other colors such as cadmium yellow, cobalt green, cobalt blue, cadmium red, ultramarine blue, indanthlene blue, phthalocyanine blue, etc.; and pearl gray pigments as disclosed, e.g., in Japanese Patent Publication Nos. 25644/68, 3897/73, 3824/74, 11727/74, 11728/74, 11729/74, 49173/74, 49174/74, 6172/76 and 3406/79. The pearl gray pigments are mainly those formed by coating tabular nuclei with the aforesaid white pigment and/or pigment of other color at a thickness giving a preferred optical property, but pearl gray pigments for use in this invention are not limited to these production process and materials. Particularly preferred pigments which are used for the spacing layer in this invention are titanium oxide, zirconium oxide and certain pearl gray pigments. Titanium oxide, zirconium oxide and various pearl gray pigments can be generally selected from commercial products, and, in particular, pearl gray pigments are commercially available as trademarks of, for example, Flamenco-Blue 100, Flamenco-Green 100, and Flamenco-Red 100 from Mearl Co.

More preferred pearl gray pigment has a nucleus portion of a thin thickness (less that about 1 $\mu$m). The particularly preferred pearl gray pigment is the pigment having no nucleus portion prepared by coating a tabular nucleus with a pigment to provide a thickness giving a preferred optical property and then removing the nucleus by a chemical and/or physical method.

The content of the solid pigment in the spacing layer depends upon the desired effect and the nature of the material to be used, but is preferably not over about 3 g/m$^2$.

The nondiffusible compounds (the compounds capable of undergoing a redox reaction with the oxidation product of a silver halide developing agent under an alkaline condition) contained in the spacing layers in this invention include, for example, the compounds shown by the following formulae (I) to (V) and dye-releasing redox compounds as described hereinafter and among these compounds, substantially colorless compounds (not including dye-releasing redox compounds) shown by formulae (I) to (V) are preferred.

Formulae (Ia) and (Ib) have the structures

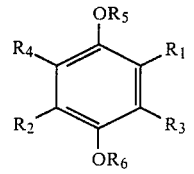

(Ia)

and

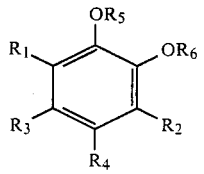

(Ib)

wherein $R_1$, $R_2$, $R_3$ and $R_4$ each represents a hydrogen atom, a halogen atom, an alkyl group, an alkenyl group, an aryl group, an amino group, an alkoxy group, an aryloxy group, a thioalkyl group, an alkaneamido group, an arylamido group, an alkylsulfonyl group, an arylsulfonyl group, an alkylsulfamoyl group, an alkylcarbamoyl group, an arylcarbamoyl group, a sulfonic acid or a salt thereof, or a carboxylic acid or a salt thereof; and one of said $R_1$, $R_2$, $R_3$ and $R_4$ is a ballast group or at least two or $R_1$, $R_2$, $R_3$ and $R_4$ coact to function as a ballast group rendering the compound of formula (Ia) or (Ib) nondiffusible under an alkaline condition.

Also, the above-described alkyl group, alkenyl group, amino group, alkoxy group, aryloxy group, thioalkyl group, alkaneamido group, arylamido group, alkylsulfonyl group, arylsulfonyl group, alkylsulfamoyl group, alkylcarbamoyl group, and arylcarbamoyl group may each be further substituted.

Also, $R_5$ and $R_6$ in the above formulae represent a hydrogen atom or a protective group capable of being released under an alkaline condition; or sald $R_5$ and $R_1$ or Said $R_6$ and $R_2$ together form a 5-membered or 6-membered ring.

Specific examples of the compound represented by the above-described formulae (Ia) and (Ib) are as follows:

(A-1)

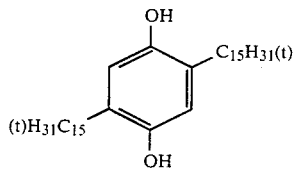

(A-2)

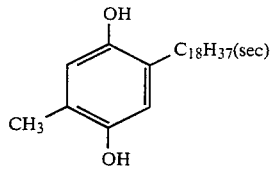

(A-3)

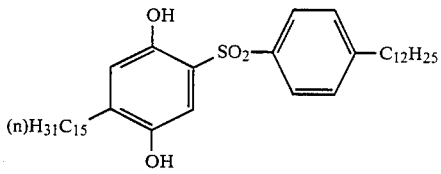

(A-4)

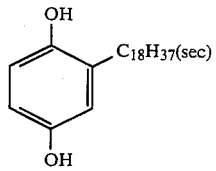

(A-5)

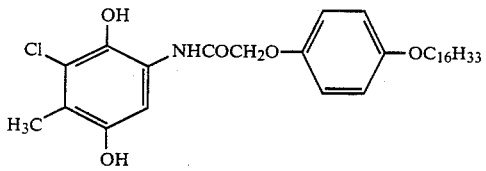

(A-6)

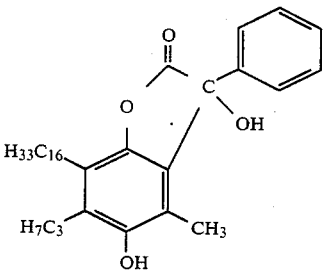

-continued (A-7)

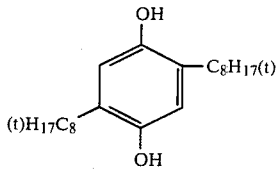

(A-8)

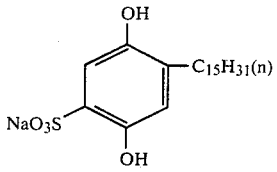

Other examples of the compounds represented by formulae (Ia) and (Ib) are the monoalkylhydroquinones described in U.S. Pat. Nos. 2,360,290, 2,418,613, 2,403,721, 3,960,570, etc.; the mono-branched alkylhydroquinones, etc., described in U.S. Pat. Nos. 3,700,453, West German Patent Application (OLS) No. 2,149,789, Japanese Patent Application (OPI) Nos. 156438/75 and 106329/74; the dialkylhydroquinones described in U.S. Pat. Nos. 2,728,659, 2,732,300 and 3,243,294, British Pat. No. 752,146, and *Chemical Abstracts,* Vol. 56, 6367h, etc.; the di-branched alkylhydroquinones described in U.S. Pat. Nos. 3,700,453, 2,732,300, 3,243,294, above-described *Chemical Abstracts,* Japanese Patent Application (OPI) Nos. 156438/75, 9528/78 and 29637/79, and Japanese Patent Publication No. 2149/75, etc.; the thioalkylhydroquinones described in *Research Disclosure,* 22827 (No. 228, 1983), etc.; the sulfonated hydroquinones described in U.S. Pat. No. 2,701,197, etc.; the substituted hydroquinones described in U.S. Pat. Nos. 2,701,197, 2,710,801 and 2,704,713, Japanese Patent Application (OPI) Nos. 43521/80, 32034/78, 109344/81, 21249/83 and 65956/80, *Research Disclosure,* 12245 (No. 122, 1974), Japanese Patent Application Nos. 63409/83, 107410/83, etc., and the substituted catechols described in Japanese Patent Application (OPI) Nos. 32034/78, 21013/80, etc.

Formula (II) has the structure (II)

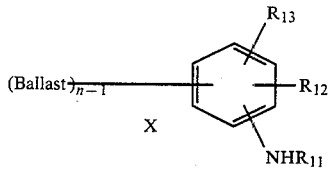

wherein $R_{11}$ represents a hydrogen atom, an alkyl group, an alkylsulfonyl group, an arylsulfonyl group, an alkylaminosulfonyl group, an arylaminosulfonyl group or a ballast group; $R_{12}$ represents a hydrogen atom, a halogen atom, an alkyl group, an aryl group, an alkoxy group, an amido group, a sulfonamido group, or a ballast group; X represents $(R_{12})_2$ (in which these two $R_{12}$s may be the same or different) or an atomic group forming a carbocyclic ring; $R_{13}$ represents a hydroxy group or a group capable of cleaving under an alkaline condition to provide a hydroxy group; (Ballast) represents a ballast group rendering the compound of formula (II) nondiffusible even under an alkaline condition; $NHR_{11}$ is at an o- or p-position with respect to $R_{13}$; and n represents 1 or 2.

The above-described alkyl group, aryl group, alkoxy group, alkylsulfonyl group, arylsulfonyl group, alkylaminosulfonyl group and arylaminosulfonyl group each may be substituted.

Specific examples of the compounds represented by formula (II) are as follows:

(B-1)

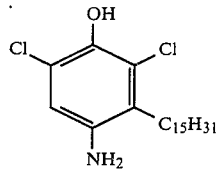

(B-2)

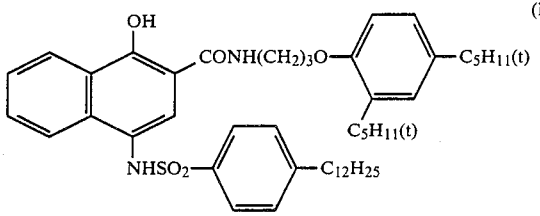

(B-3)

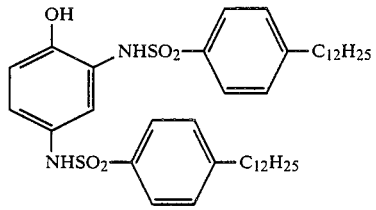

(B-4)

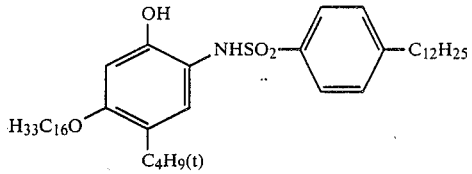

Other examples of compounds represented by formula (II) are described in *Research Disclosure,* 15162 (No. 151, 1976), ibid., 17842 (No. 178, 1979), Japanese Patent Application (OPI) No. 72158/80, U.S. Pat. No. 4,366,226, etc.

Formula (III) is represented by (III)

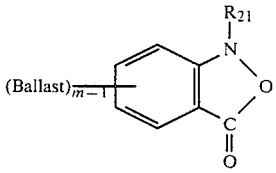

wherein $R_{21}$ represents an unsubstituted or substituted alkyl group, said alkyl group having from 1 to 20 carbon atoms, an unsubstituted or substituted aryl group (e.g., a phenyl group, a benzyl group, a chlorophenyl group, etc.), or a ballast group; (Ballast) represents a ballast group rendering the compound of formula (III) nondiffusible even under an alkaline condition; and m represents 1, 2 or 3, in proviso that when m is 0, $R_{21}$ represents a ballast group.

A specific example of the compound represented by formula (III) is as follows:

(C-1)

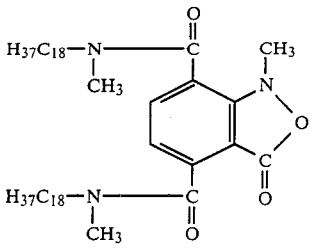

Other examples of the compounds represented by formula (III) are described in Japanese Patent Application (OPI) No. 73049/80.

Formula (IV) has the structure (IV)

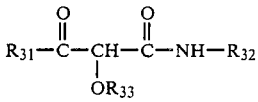

wherein $R_{31}$ represents an alkyl group or an aryl group; $R_{32}$ represents an alkyl group or an aryl group; and $R_{33}$ represents a hydrogen atom or a group capable of being released under an alkaline condition; and $R_{31}$ or $R_{32}$ is a ballast group or $R_{31}$ and Rhd 32 coact to function as a ballast group rendering the compound of formula (IV) nondiffusible even under an alkaline condition. The above-described alkyl group and aryl group may be further substituted.

Specific examples of the compounds represented by formula (IV) are as follows:

(D-1)

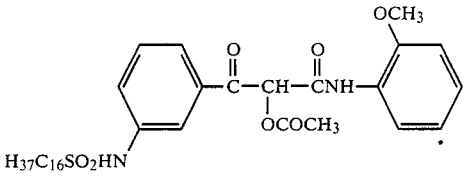

(D-2)

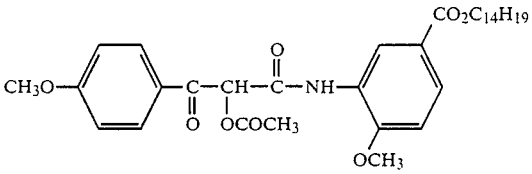

Other examples of the compounds represented by formula (IV) are described in *Research Disclosure,* 19429 (No. 194, 1980), etc.

Formula (V) has the structure (V)

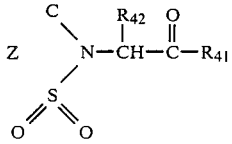

wherein $R_{41}$ represents an aryl group, which may be substituted (e.g., a phenyl group, a naphthyl group, a chlorophenyl group, etc.); $R_{42}$ represents a hydrogen atom, an alkyl group, an aryl group, an acyl group, an amido group, or an ester group (said alkyl group, aryl group, etc., may be further substituted); Z represents an atomic group forming a 5-membered or 6-membered ring together with C, N, and S; and $R_{41}$ or $R_{42}$ is a ballast group or $R_{41}$ and $R_{42}$ coact to function as a ballast group rendering the compound of formula (V) nondiffusible even under an alkaline condition.

A specific example of a compound of formula (V) is as follows:

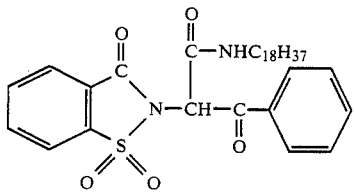

Other examples of the compounds represented by formula (V) are described in *Research Disclosure,* 19507 (No. 195, 1980), etc. Other compounds described in West German Patent Application (OLS) Nos. 2,947,425, 3,130,842, 3,144,037, etc., can also be used as the foregoing compounds.

The substantially colorless nondiffusible compound which is used in this invention and undergoes a redox reaction with the oxidation product of a silver halide developing agent under an alkaline condition can be dispersed in the same manner as the dispersion method for the dye-releasing redox compounds described hereinafter.

The hydroquinone derivative shown by formula (Ia) or (Ib) may be dispersed using the method described in Japanese Patent Application (OPI) No. 125738/81.

Also, the effective amounts of the nondiffusible compounds of layer (3) are usually from about 0.1 mol% to about 500 mol%, and preferably from about 1 mol% to about 200 mol%, based on the amount of dye-releasing redox compound associated therewith.

For the silver halide photographic emulsion layers which are used in this invention, silver bromide, silver iodobromide, silver iodochlorobromide, silver chlorobromide, or silver chloride can be used as the silver halide.

There is no particular restriction on the mean grain size of silver halide grains in the silver halide photographic emulsions ("mean grain size" as used herein refers to the diameter of a silver halide grain when the silver halide grain is a spherical grain or a grain similar to sphere, or is the length of the edge when the silver halide grain is a cubic grain, and is expressed by the mean value based on the projected area) but it is preferred that the mean grain size is 3 microns or less. The distribution of the grain size may be narrow or broad.

The silver halide grains of the photographic emulsions in this invention may have a regular crystal form such as a cubic form and an octahedral form or have an irregular crystal form such as a spherical form or a tabular form. Also, the silver halide grains may have a composite form of these crystal form as well as may be composed of a mixture of silver halide grains having various crystal forms.

The silver halide grains which are used in this invention may be composed of different phases between the inside and the surface layer or may be composed of a homogeneous phase. Furthermore, the silver halide grains may be one wherein a latent image is formed mainly on the surface of the grain or one wherein a latent image is mainly formed in the inside of the grain as described in U.S. Pat. Nos. 2,592,550, 3,206,313, etc.

For the practice of this invention, the use of a direct positive silver halide emulsion is preferred and among these direct positive emulsions, a so-called internal latent image type direct positive silver halide photographic emulsion containing silver halide grains mainly forming latent images in the inside of the grain is preferred. Among the internal latent image type photographic emulsions, a core/shell type silver halide photographic emulsion is particularly preferred. Examples of the core/shell type internal latent image type direct positive silver halide emulsions which are used in this invention are described in, for example, U.S. Pat. No. 3,761,276, etc.

The silver halide photographic emulsions for use in this invention can be prepared by the methods described in Glafkides, *Chimie et Physique Photographique* (published by Paul Montel Co., 1967), G. F. Duffin, *Photographic Emulsion Chemistry* (published by The Focal Press, 1966), V. L. Zelikman et al., *Making and Coating Photographic Emulsion* (published by The Focal Press, 1964), etc. That is, the photographic emulsions may be prepared by an acid process, a neutral process, an ammonia process, etc. Also, the reaction of a soluble silver salt and a soluble halide may be performed by a one-side mixing method, a simultaneous mixing method, or a combination of such methods.

The silver halide emulsion may be also prepared using a so-called reversal mixing method wherein silver halide grains are formed in the presence of an excessive amount of silver ion. As one mode of the simultaneous mixing methods, a so-called controlled double jet method wherein the value of pAg in the liquid phase forming therein silver halide is kept at a constant value may be used. According to the controlled double jet method, a silver halide emulsion wherein the crystal form is regular and the grain size is almost uniform is obtained.

Two or more kinds of silver halide emulsions each prepared separately may be mixed to provide a silver halide photographic emulsion for use in this invention.

The formation or physical ripening of silver halide grains may be performed in the presence of a cadmium salt, a zinc salt, a lead salt, a thallium salt, an iridium salt or a complex salt thereof, a rhodium salt or a complex salt thereof, or an iron salt or a complex salt thereof.

The silver halide photographic emulsions in the photosensitive element of this invention may be spectrally sensitized to blue light, green light, or red light of a relatively long wavelength by sensitizing dyes. Sensitizing dyes which are used for this purpose include cyanine dyes, merocyanine dyes, complex cyanine dyes, complex merocyanine dyes, holopolar cyanine dyes, styryl dyes, hemicyanine dyes, oxonol dyes, hemioxonol dyes, etc.

Examples of the useful sensitizing dyes for use in this invention are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025 3,745,014, 3,713,828, 3,567,458, 3,625,698, 2,526,632, 2,503,776, Japanese Patent Application (OPI) No. 76525/73, Belgian Patent No. 691,807, etc.

For the photographic elements of this invention, various kinds of photographic supports can be used.

In the photographic elements of this invention, the spacing layer, a color mixing preventing agent-containing layer, a dye-releasing redox compound-containing layer, silver halide photographic emulsion layers and other hydrophilic colloid layers can be hardened by proper hardening agents. These hardening agents include aldehyde series hardening agents such as formaldehyde, mucohalogenic acid, etc.; hardening agents having active halogen; dioxane derivatives; and oxypolysaccharides such as oxystarch, etc.

The photographic layers containing silver halide photographic emulsions may further contain other additives useful for the photographic emulsions, such as, for example, lubricants, antifoggants, stabilizers, sensitizers, light-absorbing dyes, plasticizers, etc.

In the photographic elements of this invention, the spacing layer, the color mixing preventing agent-containing layers, the dye-releasing redox compound-containing layers, and other hydrophilic colloid layers can contain thickeners as described, for example, in Japanese Patent Publication No. 3582/60, etc.

Also, the photographic elements of this invention may further contain surface active agents such as nonionic surface active agents, ionic surface active agents, and amphoteric surface active agents for various purposes. For example, there are polyoxyalkylene derivatives, amphoteric amino acids (including sulfobetaines), etc. Such surface active agents are described in U.S. Pat. Nos. 2,600,831, 2,271,622, 2,271,623, 2,275,727, 2,787,604, 2,816,920 and 2,739,891, Belgian Pat. No. 652,862, etc.

Examples of the color mixing preventing agents which can be used in this invention are the dihydroxybenzene derivatives described in U.S. Pat. Nos. 2,336,327, 2,360,290, 2,403,721, 3,700,453, 2,701,197, Japanese Patent Application (OPI) Nos. 2128/71, 29637/79, 9528/78, 52056/80, etc.; as well as dihydroxynaphthalene derivatives, aminonaphthol derivatives, sulfonamidophenol derivatives, sulfonamidonaphthol derivatives, etc.

It is necessary that these compounds have an appropriate ballast group for advantageously functioning as color mixing preventing agents.

The coating amount of the color mixing preventing agent is usually from $1\times10^{-4}$ to $1\times10^{-2}$ mol/m$^2$, and preferably from $5\times10^{-4}$ to $5\times10^{-3}$ mol/m$^2$.

Any dye-providing compounds which can imagewise release or form diffusible dyes or precursors for diffusible dyes as a result of development can be used in this invention, and, for example, dye developers and nondiffusible couplers capable of releasing diffusible dyes can be used, but dye-releasing redox compounds are preferably used. The dye-releasing redox compounds which are used in this invention may be of a negative-working type or a positive-working type, but are preferably of a negative-working type.

The dye-releasing redox compounds for use in this invention can be represented by the formula (VI)

$$Y—D \qquad (VI)$$

wherein D represents a dye or a precursor thereof and Y represents a group functioning to imagewise release a diffusible dye or a precursor thereof as a result of development, said Y and D may be combined with each other, if desired, through a divalent linking group.

Practical examples of Y in the above formula are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, Japanese Patent Application (OPI) Nos. 50736/78, 104343/76, 130122,79, 110827/78, 12642/81, 16131/81, 4043/82, 650/82, 20735/82, 69033/78, 130927/79, 164342/81, 119345/82, etc.

Among the groups shown by Y of the negative-working dye-releasing redox compounds, the particularly preferred groups include N-substituted sulfamoyl groups (examples of the N-substituting group are groups induced from aromatic hydrocarbon rings or heterocyclic rings). Specific examples of the groups shown by Y are illustrated below, but the groups of Y in this invention are not limited thereto.

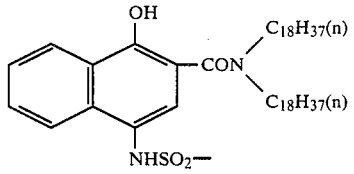

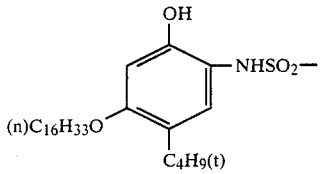

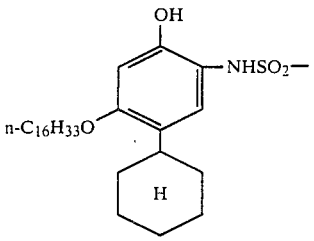

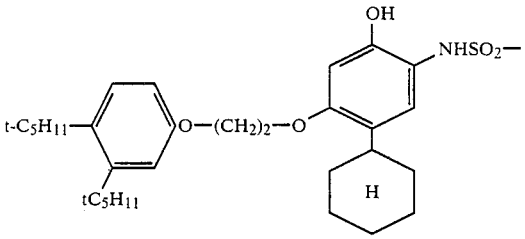

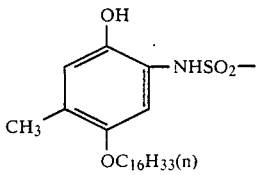

-continued

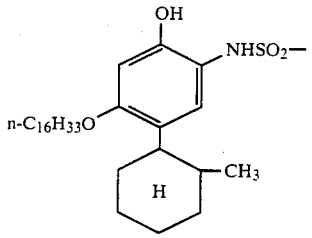

Also, specific examples of the group shown by Y of the positive-working type dye-releasing redox compounds are shown below.

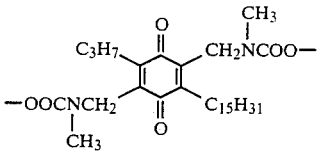

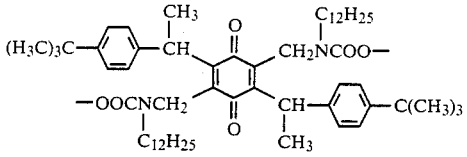

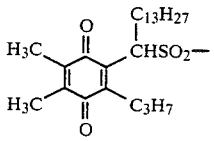

In the case of using this type of compound, it is preferred to use the compound as an association with a nondiffusible electron donative compound (hereinafter as referred to as an ED compound) or a precursor thereof.

Examples of the ED compound are described, for example, in U.S. Pat. Nos. 4,263,393, 4,278,750, Japanese Patent Application (OPI) No. 138736/81, etc.

On the other hand, specific examples of the dye shown by D of the above-described formula (VI) are described in the following literature.

Examples of the yellow dyes are described in U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application (OPI) Nos. 114930/76, 71072/81, *Research Disclosure,* 17630 (1978), ibid., 16475 (1977), etc.

Examples of the magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, Japanese Patent Application (OPI) Nos. 106727/77, 23628/78, 36804/80, 73057/81, 71060/81, 134/80, etc.

Examples of the cyan dyes are described in U.S. Pat. Nos. 3,482,972, 3,929,760, 4,013,635, 4,268,625, 4,171,220, 4,242,435, 4,142,891, 4,195,994, 4,147,544, 4,148,642, British Pat. No. 1,551,138, Japanese Patent Application (OPI) Nos. 99431/79, 8827/77, 47823/78, 143323/78, 99431/79, 71061/81, European Patent (EPC) Nos. 53,037, 53,040, *Research Disclosure,* 17630 (1978), ibid., 16475 (1977), etc.

Also, other specific examples of dye-providing compounds which can be used in this invention are as follows:

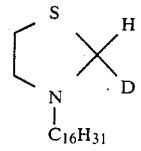

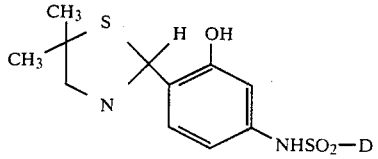

wherein D represents the same dye or precursor thereof as defined in formula (VI) above.

The details of the above compounds are described in U.S. Pat. Nos. 3,719,489 and 4,098,783.

The coating amount of dye-releasing redox compound is usually from about $1\times10^{-4}$ to about $1\times10^{-2}$ mol/m$^2$, and preferably from about $2\times10^{-4}$ to about $2\times10^{-3}$ mol/m$^2$.

The non-diffusible compound undergoing a redox reaction, which is used for the spacing layer in this invention, can be dispersed in a hydrophilic colloid medium in various manners according to the nature of the compound. For example, a redox compound which is sparingly soluble in an aqueous medium and is easily soluble in an organic solvent is dissolved in an organic solvent and the solution thus obtained is added to an aqueous solution of a hydrophilic colloid and dispersed as fine particles by stirring, etc.

Examples of the proper solvent which is used for the above purpose are ethyl acetate, tetrahydrofuran, methyl ethyl ketone, cyclohexanone, β-butoxy-β-ethoxyethyl acetate, dimethylformamide, dimethyl sulfoxide, 2-methoxyethanol, tri-n-butyl phthalate, etc. The dispersing solvent having a relatively low vapor pressure can be volatilized off during drying of the photographic layer, or can be volatilized off before coating the coating composition containing the solvent by a method as described in U.S. Pat. Nos. 2,322,027 and 2,801,171. Also, the dispersing solvent which is easily soluble in water can be removed by the water washing method as described in U.S. Pat. Nos. 2,949,360 and 3,396,027.

Furthermore, the dispersion method described in Japanese Patent Application (OPI) No. 138726/78 can be utilized.

The dispersion of the redox compound is effectively achieved under a high shearing force. For example, a high speed rotary mixer, a colloid mill, a high pressure milk homogenizer, the high pressure homogenizer disclosed in British Pat. No. 1,304,264, or an ultrasonic emulsifier is advantageously used.

As surface active agents which are advantageously used for the dispersion of redox compounds, there are sodium triisopropylnaphthalenesulfonate, sodium dinonylnaphthalenesulfonate, sodium p-dodecylbenzenesulfonate, sodium dioctylsulfosuccinate, sodium cetylsulfate, and the anionic surface active agents disclosed in Japanese Patent Publication No. 4293/64. The use of the anionic surface active agent together with a higher fatty acid ester or anhydrohexitol shows a particularly good emulsification power, as disclosed in U.S. Pat. No. 3,676,141.

The color mixing preventing agents and the dye-releasing redox compounds which can be used in this invention can be also dispersed by the same manner as described above.

In the case of processing the photographic elements of this invention, any silver halide developing agents which can cross-oxidize the dye-providing compounds can be used. Such a developing agent may be incorporated in an alkaline processing composition or may be incorporated in a proper layer of the photographic element. Examples of the developing agents which can be used in this invention are hydroquinones, aminophenols (e.g., N-methylaminophenol, etc.), pyrazolidones (e.g., phenidone, 1-p-tolyl-4-methyl-4-hydroxymethyl-3-pyrazolidone, dimeson, 1-p-tolyl-4,4-dihydroxymethyl-3-pyrazolidone, 1-phenyl-4-methyl-4-hydroxymethyl-3-pyrazolidone, etc.), phenylenediamines (e.g., N,N-diethyl-p-phenylenediamine, 3-methyl-N,N-diethyl-p-phenylenediamine, 3-methoxy-N-ethoxy-p-phenylenediamine, etc.), etc.

Among the above-described compounds, a black-and-white developing agent having a property of reducing the formation of stain in an image-receiving layer is generally more preferred than a color developing agent such as phenylenediamines.

The fogging agents (nucleating agents) which can be used in this invention are described, for example, in U.S. Pat. Nos. 2,588,982, 2,568,785, 3,227,552, 3,615,615, 4,030,925, 4,031,127, 3,718,470, 4,266,013, etc.

The alkaline processing composition may further contain a compound capable of accelerating the development or accelerating the diffusion of dye (e.g., benzyl alcohol, etc.).

The image-receiving layer, the neutralizing layer, the neutralization speed controlling layer (timing layer) and the processing composition described, for example, in U.S. Pat. No. 4,268,625, can be used for the photographic element of this invention.

In a preferred embodiment of the photographic element of this invention, there is a film unit of the tyep of the constitution that after imagewise exposure, the film unit is processed by a photographic processing composition by passing through a pair of juxtaposed pressure-applying members.

A type of the film unit which is of a laminated unitary type (i.e., integrated type) and to which the invention is most preferably applied is disclosed in British Pat. No. 1,330,524. According to this embodiment of this invention, a transparent cover sheet is disposed on the photographic element of this invention in a face-to-face relationship. A rupturable container containing an alkaline processing composition having added thereto an opacifying agent (e.g., carbon black) for light-shielding is disposed adjacent the uppermost layer (protective layer) of the photosensitive element and the transparent cover sheet.

Such a film unit is imagewise exposed through the transparent cover sheet and then the rupturable container is ruptured during withdrawal of the film unit from a camera, whereby the processing composition (containing opacifying agent) is uniformly spread between the aforesaid protective layer and the cover sheet. Thus, the photosensitive layers are light-shielded in a sandwiched form and the development of the photosensitive layers proceeds in the dark.

It is preferred that the above-described neutralization mechanism be incorporated in the film units of these embodiments.

In this case, it is preferred to form the neutralizing layer on the cover sheet (if desired, a timing layer is further formed thereon at the side onto which the processing composition is spread).

Also, the photographic element of this invention can be applied to the peel-apart type film unit as described in U.S. Pat. No. 2,983,606.

The following examples are intended to illustrate this invention, but not to limit it in any way.

EXAMPLE 1

Comparison Photographic Element I was prepared by coating, in succession, the following layers on a transparent polyethylene terephthalate film support.

(1') An image-receiving layer containing 4.0 g/m$^2$ of copoly[styrene-N-vinylbenzyl-N,N,N-trihexylammonium chloride] and 4.0 g/m$^2$ of gelatin.

(2') A white reflecting layer containing 22 g/m$^2$ of titanium dioxide and 2.2 g/m$^2$ of gelatin.

(3') An opaque layer containing 2.7 g/m$^2$ of carbon black and 2.7 g/m$^2$ of gelatin.

(4') A layer containing 0.50 g/m$^2$ of the cyan dye-releasing redox compound having the following structure, 0.50 g/m$^2$ of N,N-diethyllaurylamide, and 1.5 g/m$^2$ of gelatin.

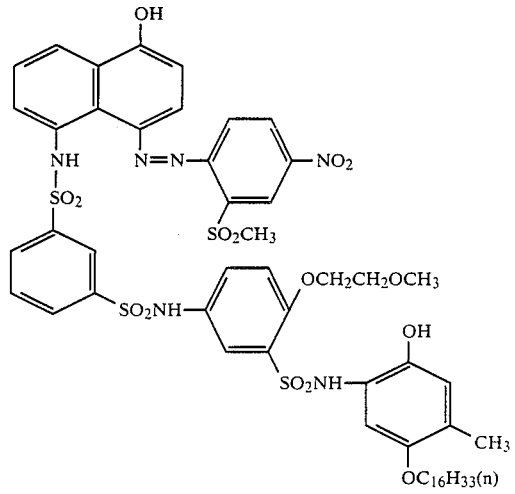

(5') A spacing layer containing 0.3 g/m$^2$ of titanium dioxide and 0.68 g/m$^2$ of gelatin.

(6') A layer containing a red-sensitive internal latent image type direct positive silver iodobromide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)-phenyl]hydrazine and 10.067 g/m$^2$ of sodium 2-pentadecylhydroquinone-5-sulfonate.

(7') A color mixing preventing agent-containing layer containing 1.0 g/m$^2$ of gelatin, 1.0 g/m$^2$ of 2,5-di-t-pentadecylhydroquinone, and 0.5 g/m$^2$ of tricresyl phosphate.

(8') A dye-releasing redox compound transfer preventing layer containing 0.5 g/m$^2$ of gelatin.

(9') A layer containing 0.80 g/m$^2$ of the magenta dye-releasing redox compound having the following structure, 0.20 g/m$^2$ of N,N-diethyllaurylamide, and 1.2 g/m$^2$ of gelatin.

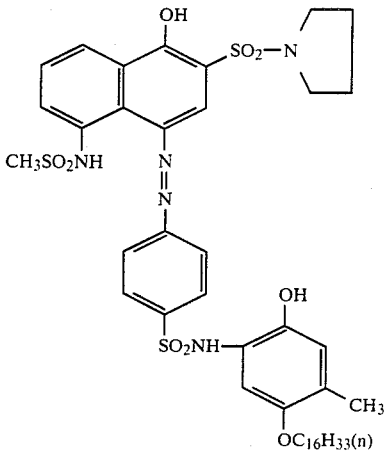

(10′) A spacing layer containing 0.15 g/m² of titanium dioxide and 0.70 g/m² of gelatin.

(11′) A layer containing a green-sensitive internal latent image type silver iodobromide emulsion (1.1 g/m² of gelatin and 1.4 g/m² of silver), 0.015 g/m² of 1-acetyl-2-[4-(2,4-di-t-pentylphenoxyacetamido)-phenyl]hydrazine, and 0.067 g/m² of sodium 2-pentadecylhydroquinone-5-sulfonate.

(12′) A color mixing preventing agent-containing layer containing 1.0 g/m² of gelatin, 1.0 g/m² of 2,5-di-t-pentadecylhydroquinone, and 0.5 g/m² of tricresyl phosphate.

(13′) A dye-releasing redox compound transfer preventing layer containing 0.5 g/m² of gelatin.

(14′) A layer containing 1.0 g/m² of the yellow dye-releasing redox compound having the following structure, 0.25 g/m² of N,N-diethyllaurylamide, and 1.0 g/m² of gelatin.

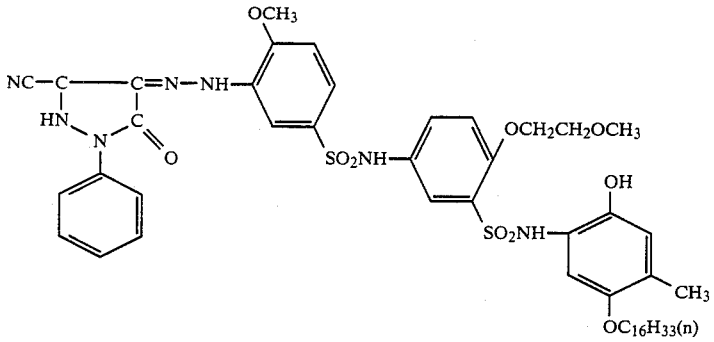

(15′) A spacing layer containing 0.15 g/m² of titanium dioxide and 0.43 g/m² of gelatin.

(16′) A layer containing a blue-sensitive internal latent image type direct positive silver iodobromide emulsion (1.1 g/m² of gelatin and 1.4 g/m² of silver), 10.015 g/m² of 1-acetyl-2-[4-(2,4-di-t-pentylphenoxyacetamido)phenyl]hydrazine, and 0.067 g/m² of sodium 2-pentadecylhydroquinone-5-sulfonate.

(17′) A protective layer containing 1.3 g/m² of gelatin, 0.9 g/m² of a latex of polyethyl acrylate, 0.5 g/m² of tinuvin, and 0.026 g/m² of a hardening agent, triacryloyl perhydrotriazine.

Photographic Element II of this invention was prepared by following the same manner as the case of preparing Comparison Photographic Element I, except that $3.6\times10^{-4}$ mol/m² of the above-described Compound A-7) was added to each of the spacing layers (5′), (10′) and (15′) of Photographic Element I.

Also, Photographic Element III of this invention was prepared by the same manner as Photographic Element II above except that $3.6\times10^{-4}$ mol/m² of the above-described Compound A-1) was used in place of Compound A-7). Photographic Element IV was prepared by the same manner as above except that $3.6\times10^{-4}$ mol/m² of the above-described Compound D-2) was used in place of Compound A-7).

Furthermore, Comparison Photographic Element V was prepared by following the same manner as the case of preparing Photographic Element I except that Compound A-1) was added to each of layers (6′), (11′) and (16′) of Photographic Element I. Also, Comparison Photographic Element VI was prepared by following the same manner as the case of preparing Photographic Element I except that Compound A-1) was added to layers (4′), (9′) and (14′) of Photographic Element I. Moreover, Comparison Photographic Element VII was prepared by following the same manner as the case of preparing Photographic Element I except that the spacing layers (5′), (10′) and (15′) were omitted.

A cover sheet was prepared by coating, in succession, the following layers on a transparent polyethylene terephthalate film support.

(1) A neutralizing layer composed of 10 g/m² of polyacrylic acid.

(2) A timing layer composed of 10 g/m² of acetyl cellulose.

Each of the photographic elements prepared as described above was exposed to tungsten light of 2,854° K. through an optical wedge having a density difference of 0.2 (the maximum exposure amount was 10 C.M.S.).

The above-described cover sheet was displaced on the photographic element thus exposed with a pouch-form container containing the viscous processing liquid having the following composition between them at the edge portions thereof and the processing liquid was uniformly spread between the photographic element and the cover sheet by passing the assembly through a pair of juxtaposed pressure-applying rollers.

| Composition of Viscous Processing Liquid: | |
|---|---|
| Water | 820 ml |
| $1NH_2SO_4$ | 5 ml |
| Hydroxyethyl Cellulose | 60 g |
| 4-Hydroxymethyl-4-methyl-1-phenyl-3-pyrazolone | 5 g |
| 5-Methylbenzotriazole | 2 g |
| t-Butylhydroquinone | 0.4 g |
| Sodium Sulfite | 2 g |

-continued

| Composition of Viscous Processing Liquid: | |
|---|---|
| Carbon Black | 150 g |
| Sodium Hydroxide | 30 g |

Spreading of the processing liquid was performed at each temperature of 10° C., 25° C. and 35° C. and by measuring the density of each image formed after 1 hour since spreading the processing liquid, the results shown in Table 1 below were obtained. The photographic image thus obtained was a positive image in each case.

TABLE 1

| Photographic Element | | $S_{0.5*}$ 10° C. | 25° C. | 35° C. |
|---|---|---|---|---|
| I | Yellow | 100 | 71 | 54 |
| (Comparison) | Magenta | 100 | 62 | 43 |
| | Cyan | 100 | 85 | 81 |
| II | Yellow | 100 | 81 | 70 |
| (A-7) | Magenta | 102 | 74 | 66 |
| | Cyan | 100 | 89 | 86 |
| III | Yellow | 103 | 98 | 97 |
| (A-1) | Magenta | 104 | 97 | 97 |
| | Cyan | 101 | 100 | 100 |
| IV | Yellow | 100 | 82 | 72 |
| (D-2) | Magenta | 101 | 75 | 68 |
| | Cyan | 101 | 90 | 88 |
| V | Yellow | 110 | 74 | 55 |
| (Comparison) | Magenta | 112 | 63 | 45 |
| | Cyan | 106 | 85 | 82 |
| VI | Yellow | 113 | 75 | 54 |
| (Comparison) | Magenta | 110 | 62 | 46 |
| | Cyan | 108 | 86 | 83 |
| VII | Yellow | 63 | 48 | 39 |
| (Comparison) | Magenta | 60 | 39 | 29 |
| | Cyan | 71 | 61 | 62 |

In the above table:
$S_{0.5*} = 100 \times 10^{-(\log E - \log E_{f})}$: The relative sensitivity to Photographic Element I at a density of 0.5.
log E: The log E value of each photographic element showing a density of 0.5.
log $E_f$: The log E value of Photographic Element I showing a density of 0.5.

From the results shown in Table 1, it can be seen that Photographic Elements II, III and IV having the spacing layers containing the compounds according to this invention show less change of sensitivity by the difference of the processing temperature as compared to Comparison Photographic Elements I, V, VI and VII.

EXAMPLE 2

Photographic Element VIII was prepared by coating, in succession, the following layers on a polyethylene terephthalate film support provided with a light-shielding property by kneading therein 12% by weight carbon black.

(1″) A layer containing 1.0 g/m² of the yellow dye-releasing redox compound having the following structure, 0.25 g/m² of N,N-diethyllaurylamide, and 1.0 g/m² of gelatin.

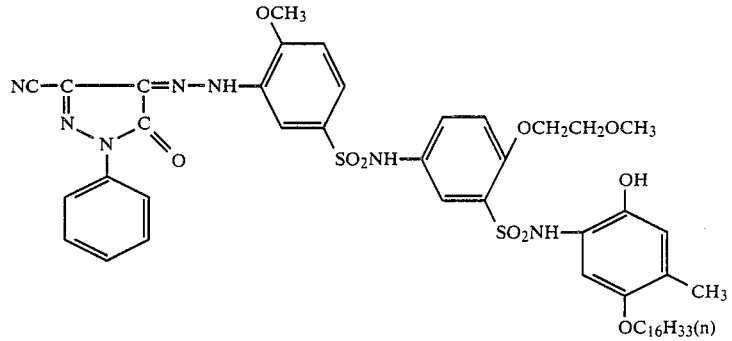

(2″) A spacing layer containing 0.15 g/m² of titanium dioxide and 0.43 g/m² of gelatin.

(3″) A layer containing a blue-sensitive internal latent image type silver bromide emulsion (1.1 g/m² of gelatin and 1.4 g/m² of silver), 10.015 g/m² of 1-acetyl-2-[4-(2,4-di-t-pentylphenoxyacetamido)phenyl]hydrazine, and 0.067 g/m² of sodium 2-pentadecylhydroquinone-5-sulfonate.

(4″) A layer containing 1.0 g/m² of gelatin.

Photographic Element IX of this invention was prepared by following the same procedure as the case of preparing Photographic Element VIII except that $3.6 \times 10^{-4}$ mol/m² of Compound A-1) was incorporated in the spacing layer (2″).

Each of the photographic elements thus obtained was imagewise exposed through a continuous wedge to tungsten light of 2,854° K. which was converted into 4,800° K. through a David-Gibson filter (the maximum exposure amount in this case was 10 C.M.S.). The exposed film was processed as described below by the processing liquid having the following composition.

| Processing Composition: | |
|---|---|
| Potassium Hydroxide | 56 g |
| 4-Hydroxymethyl-4-methyl-1-p-tolyl-3-pyrazolidine | 6 g |
| 5-Methylbenzotriazole | 5 g |
| Methylhydroquinone | 0.2 g |
| Sodium Sulfite | 0.8 g |
| Benzyl Alcohol | 2 ml |
| Hydroxyethyl Cellulose | 50 g |
| Water to make | 1 liter |

On the other hand, an image-receiving sheet was prepared by coating, in succession, the following layers on a paper support the opposite side of which was laminated with polyethylene containing carbon black to impart a light shielding property to the paper support.

(1‴) A neutralizing layer formed by coating 17 g/m² of polyacrylic acid, 0.06 g/m² of N-hydroxysuccinimide benzenesulfonate, and 0.5 g/m² of ethylene glycol at a thickness of 7 microns.

(2‴) A timing layer formed by coating cellulose acetate (degree of acetylation: 54) at a thickness of 2 microns.

(3‴) A timing layer formed by coating a copolymer latex of vinylidene chloride and acrylic acid at a thickness of 4 microns.

(4''') An image-receiving layer containing 4.0 g/m$^2$ of copoly[styrene-N-vinylbenzyl-N,N,N-trihexylammonium chloride] and 4.0 g/m$^2$ of gelatin.

(5''') A spacing layer containing 2.0 g/m$^2$ of phthalated gelatin.

The development of the above-described photographic element was performed as in Example 1. That is, each of the photographic elements thus exposed was superposed on the image-receiving sheet prepared above with a rupturable container containing the aforesaid processing composition between both the elements and the processing composition was uniformly spread at a thickness of 80 microns between the photographic element and the image-receiving sheet by passing the assembly through a pair of juxtaposed pressure-applying rollers.

Spreading of the processing composition was performed at each temperature of 10° C., 25° C. and 35° C., after 2 minutes, the image-receiving sheet was separated from the photographic element, and the density of the image formed in the image-receiving sheet was measured. The results thus obtained are shown in Table 2.

TABLE 2

| Photographic Element | Transferred Image | $S_{0.5*}$ 10° C. | 25° C. | 35° C. |
|---|---|---|---|---|
| VIII (Comparison) | Yellow | 100 | 71 | 52 |
| IX (Invention) | Yellow | 108 | 87 | 72 |

$S_{0.5*}$: Same as the definition for Table 1.

From the results shown in Table 2, it can be seen that Photographic Element IX having the spacing layer containing the compound according to this invention shows less change of sensitivity due to change of processing temperature as compared to Comparison Photographic Element VIII.

While the invention has been described in detail and with reference to specific embodiments thereof, it will be apparent to one skilled in the art that various changes and modifications can be made therein without departing from the spirit and scope thereof.

What is claimed is:

1. A photographic element for a diffusion transfer process comprising a support having thereon (1) a layer containing a dye-providing compound capable of releasing or forming a diffusible dye or a precursor thereof as a result of development, (2) a silver halide photographic emulsion layer which is in a complementary color relationship with the dye-providing compound, and (3) a substantially non-sensitive spacing layer between said layers (1) and (2) containing a solid pigment, a hydrophilic colloid, and a nondiffusible compound capable of undergoing a redox reaction with the oxidation product of a silver halide developing agent under an alkaline condition.

2. A photographic element as in claim 1, wherein the silver halide photographic emulsion layer is formed of a direct positive silver halide photographic emulsion.

3. A photographic element as in claim 2, wherein the direct positive silver halide photographic emulsion is an internal latent image-type silver halide photographic emulsion.

4. A photographic element as in claim 2, wherein the direct positive silver halide photographic emulsion is a core/shell type internal latent image type silver halide photographic emulsion.

5. A photographic element as in claim 1, wherein the solid pigment in the spacing layer is titanium dioxide.

6. A photographic element as in claim 1, wherein the dye-providing compound is a dye-releasing redox compound.

7. A photographic element as in claim 6, wherein the dye-releasing redox compound is a negative-working dye-releasing redox compound.

8. A photographic element as in claim 1, wherein the nondiffusible compound in the spacing layer is a substantially colorless compound.

9. A photographic element as in claim 8, wherein the substantially colorless compound is a compound represented by formula (Ia) or (Ib)

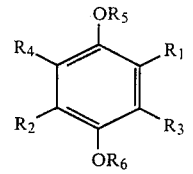

(Ia)

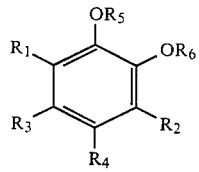

(Ib)

wherein $R_1$, $R_2$, $R_3$, and $R_4$ each represents a hydrogen atom, a halogen atom, an alkyl group, an alkenyl group, an aryl group, an amino group, an alkoxy group, an aryloxy group, a thioalkyl group, an alkaneamido group, an arylamido group, an alkylsulfonyl group, an arylsulfonyl group, an alkylsulfamoyl group, an alkylcarbamoyl group, an arylcarbamoyl group, a sulfonic acid group or a salt thereof, or a carboxylic acid or a salt thereof, and one of said $R_1$, $R_2$, $R_3$ and $R_4$ is a ballast group or at least two of said $R_1$, $R_2$, $R_3$ and $R_4$ coact to function as a ballast group rendering the compound of formula (Ia) or (Ib) nondiffusible even under an alkaline condition; and $R_5$ and $R_6$ each represents a hydrogen atom or a protective group capable of being released under an alkaline condition or said $R_5$ and $R_1$ or said $R_6$ and $R_2$ together form a 5-membered or 6-membered ring.

10. A photographic element as in claim 8, wherein the substantially colorless compound is a compound represented by formula (II)

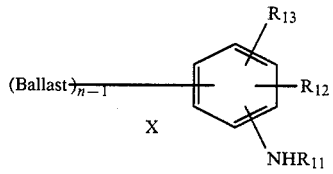

(II)

wherein $R_{11}$ represents a hydrogen atom, an alkyl group, an alkylsulfonyl group, an arylsulfonyl group, an alkylaminosulfonyl group, an arylaminosulfonyl group, or a ballast group; $R_{12}$ represents a hydrogen atom, a halogen atom, an alkyl group, an aryl group, an alkoxy group, an amido group, a sulfonamido group, or a ballast group; X represents $(R_{12})_2$ or an atomic group forming a carbocyclic ring; $R_{13}$ represents a hydroxy group or a group capable of being decomposed under an alkaline condition to provide a hydroxy group; (Ballast) represents a ballast group rendering the compound of formula II nondiffusible even under an alkaline condition; $NHR_{11}$ is at an o-position or a p-position with respect to $R_{13}$; and n represents 1 or 2.

11. A photographic element as in claim 8, wherein the substantially colorless compound is a compound represented by formula (III)

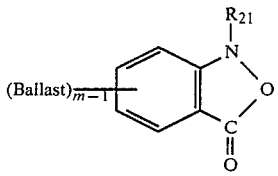

(III)

wherein $R_{21}$ represents an unsubstituted or substituted alkyl group having from 1 to 20 carbon atoms, an unsubstituted or substituted aryl group, or a ballast group; (Ballast) represents a ballast group rendering the compound of formula (III) nondiffusible even under an alkaline condition; and m represents 1, 2 or 3.

12. A photographic element as in claim 8, wherein the substantially colorless compound is a compound represented by formula (IV)

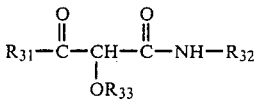

(IV)

wherein $R_{31}$ represents an alkyl group or an aryl group; $R_{32}$ represents an alkyl group or an aryl group; and $R_{33}$ represents a hydrogen atom or a group capable of being released under an alkaline condition; and $R_{31}$ or $R_{32}$ is a ballast group or $R_{31}$ and $R_{32}$ coact to function as a ballast group rendering the compound of formula (IV) nondiffusible even under an alkaline condition.

13. A photographic element as in claim 8, wherein the substantially colorless compound is a compound represented by formula (V)

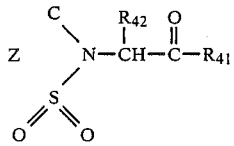

(V)

wherein $R_{41}$ represents an unsubstituted or substituted aryl group; $R_{42}$ represents a hydrogen atom, an alkyl group, an aryl group, an acyl group, an amido group, or an ester group; Z represents an atomic group forming a 5-membered or 6-membered ring together with C, N and S; and $R_{41}$ or $R_{42}$ is a ballast group or $R_{41}$ and $R_{42}$ coact to function as a ballast group rendering the compound of formula (V) nondiffusible even under an alkaline condition.

14. A photographic element as in claim 1, wherein the nondiffusible compound of layer (3) is included in an amount of from about 0.1 mol% to about 500 mol%, based on the amount of dye-releasing redox compound associated therewith.

15. A photographic element as in claim 14, wherein the nondiffusible compound of layer (3) is included in an amount of from about 1 mol% to about 200 mol%, based on the amount of dye-releasing redox compound associated therewith.

16. A photographic element as in claim 1, wherein an amount of the solid pigment of the layer (3) is about 3 $g/m^2$ or less.

17. A photographic element as in claim 1, wherein an amount of the hydrophilic colloid of the layer (3) is about 3 $g/m^2$ or less.

* * * * *